United States Patent [19]

Hartshorn et al.

[11] Patent Number: 4,532,959

[45] Date of Patent: Aug. 6, 1985

[54] VALVING ELEMENT FOR A PLATE-TYPE VALVE

[75] Inventors: Kevin Hartshorn, Plainsboro; Wallace A. McGahan, Lawrenceville, both of N.J.

[73] Assignee: Ingersoll-Rand Company, Woodcliff Lake, N.J.

[21] Appl. No.: 570,949

[22] Filed: Jan. 16, 1984

[51] Int. Cl.[3] ..... F16K 15/08

[52] U.S. Cl. ..... 137/516.13; 137/516.15

[58] Field of Search ..... 137/512.1, 516.11–516.23

[56] References Cited

U.S. PATENT DOCUMENTS 957,012 5/1910 Stone ..... 137/516.13 X 2,390,527 12/1945 Flint ..... 137/516.23

FOREIGN PATENT DOCUMENTS 687507 1/1940 Fed. Rep. of Germany ..... 137/516.21

1287164 8/1972 United Kingdom ..... 137/516.13

*Primary Examiner*—Robert G. Nilson

*Attorney, Agent, or Firm*—B. J. Murphy

[57] ABSTRACT

The valving element, according to the first embodiment depicted, comprises a plate-type element having an undulated or scalloped edge or periphery. The plate-type element has a plurality of flow ports formed therein each of which subtends an arc drawn from the radial center of the element. The ends of the ports, which otherwise would be subject to fatigue, failure and fracture, are spaced further from the edge than in prior art practice. Accordingly, the shock of impact of the plate-type element on opening or closing is less likely to precipitate fatigue and failure of the port ends. Additionally, at a plurality of locations about the periphery, the plate-type element has linear portions; upon the plate-type element impacting on any of these linear portions, it will make a line contact which more readily disperses the impact shock.

21 Claims, 10 Drawing Figures

VALVING ELEMENT FOR A PLATE-TYPE VALVE

This invention pertains, specifically, to valving elements, and generally to valves within which such elements function, such as the valves used in reciprocating gas compressors. These valves are essentially one-way devices allowing gas flow in a single direction. They (i.e., the valving elements therein) respond to pressure differences across them and, commonly, closing springs are used to assist the valving elements therein in closing at a particular time relative to the compressor cycle.

Valving elements come in a variety of types, and the particular one addressed by this disclosure is of the plate type well known in the prior art. Exemplary thereof are the plate-type valving elements in the "Plate Valve" disclosures in U.S. Pat. Nos. 3,327,731 and 3,703,912, issued to T. K. Kehler, and F. Bauer, et al., respectively, on June 27, 1967 and Nov. 28, 1972. Each of such valving elements, essentially, is a series of concentric rings joined together by webs and strengthened by radial ligaments. They can range in diameter from approximately three inches up to twelve inches, and have a typical plate thickness of 0.080 inches.

Valving elements in plate-type valves cycle as high as twenty times per second with total lifts of approximately 0.060 inches. Typically, impact velocities thereof, at the valve seat, are in the four to eight feet per second range although, in some cases, impacts in excess of ten feet per second have been measured. Impact of the valving element with the valve seat has been shown, experimentally, to produce high stresses in the outer rim near the thereadjacent flow port(s). Typically, the valving element approaches the valve seat in a tilted manner. Contact then takes place over a small area, i.e., a point contact, of the valving element periphery, causing bending. Eventually, the valving element plate material fatigues, and a crack develops, forcing the machine (i.e., gas compressor) to be shut down for repairs to be made.

It is an object of this invention to disclose a valving element for a plate-type valve which is not subject to early fatigue, failure and fracture. It is also an object of this invention to set forth a valving element for a plate-type valve, comprising a plate; said plate having (a) apertures formed therein for the conduct of fluid therethrough, (b) a given center, and (c) an outer periphery defining the outermost edge of said plate; wherein said apertures subtend given arcs drawn from said given center; and given ones of said apertures each have a first portion intermediate the length thereof which is more proximate to said edge than are other portions thereof which subsist at either sides of said first portion.

It is further an object of this invention to disclose a valving element for a plate type valve, comprising a plate; said plate having (a) apertures formed therein for conduct of fluid therethrough, (b) a given center, and (c) an outermost periphery; and wherein said periphery is defined, at least in part, by a plurality of radii drawn from radial centers which are spaced apart from said given center.

Further objects of this invention, as well as the novel features thereof, will become more apparent by reference to the following description taken in conjunction with the accompanying figures, in which.

Figure 1:
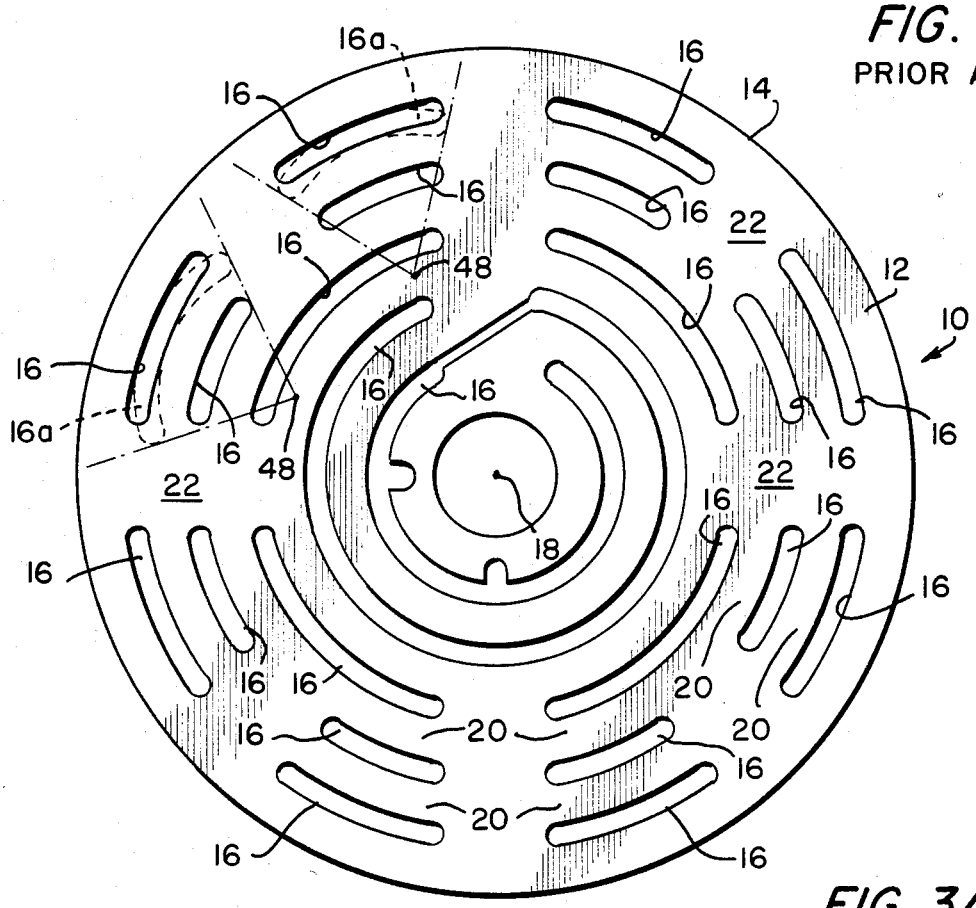
FIG. 1 PRIOR ART
FIG. 1 is a plan view of a prior art, plate-type, valving element similar to those in the cited U.S. patents.
Figure 2A:
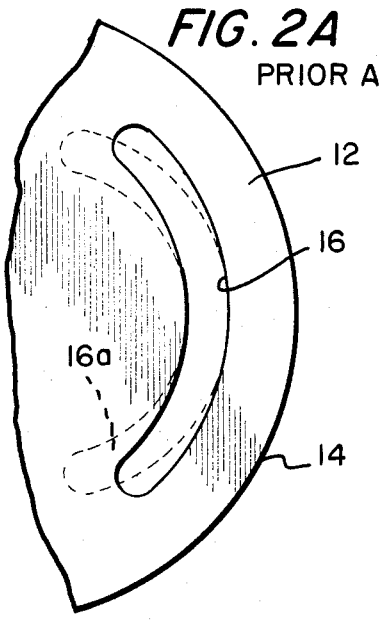
FIG. 2A PRIOR ART
FIGS. 2A and 2B are (a) a partial plan view of an edge of such a prior art, valving element, and (b) an illustration in simple line drawing of such a plate approaching contact with its valving plate, the angle of incidence being shown in exaggeration only to clarify the matter.
Figure 3A:
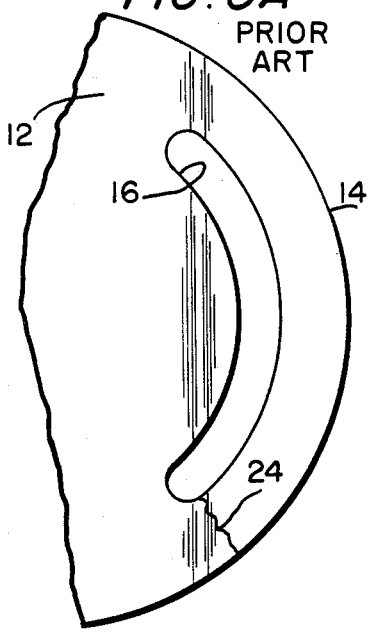
FIG. 3A PRIOR ART
FIGS. 3A and 3B are illustrations, generally corresponding with FIGS. 2A and 2B, representing the valving element (of FIGS. 2A and 2B) upon its having made contact with the valve seat, and showing a fatigue fracture occurring therein.
Figure 2B:
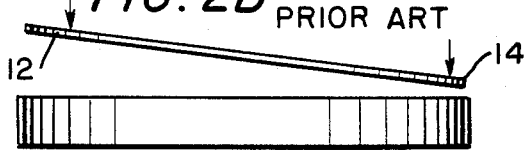
FIG. 2B PRIOR ART
Figure 3B:
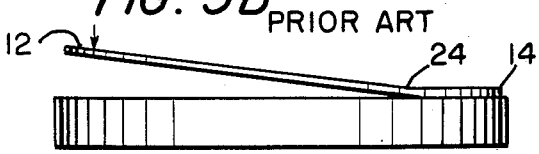
FIG. 3B PRIOR ART

As shown in the figures, plate type valving elements 10, as is well known from the prior art, commonly comprise a plate 12 having a circular edge or periphery 14, and having a plurality of apertures, or flow ports 16, formed therethrough, the same being arrayed, concentrically, about the radial center 18 of the plate 12. The apertures, or flow ports 16, are separated therebetween by webs 20, and radial ligaments 22, extending radially in the plate 12, strengthen the ports 16. In use, commonly the plates 12 are cycled at a high rate, and almost always impact on the complementary valve seat at an angle. Consequently, inwardly of the point of contact, bending occurs. Too soon, the plate metal fatigues and experiences a fracture 24, usually through an area adjacent an end of a radially-outermost flow port 16.

In order to render such valving elements more durable and long-lived, the invention contemplates the strengthening thereof adjacent the ends of the outermost flow ports 16, and straightening the edge of the plate, in a plurality of locations, to avoid point-contact impacts. This is realized by defining the plate **12*a* with an undulated or scalloped periphery 14*a*, as shown in the embodiment of FIG. 4**.

Figure 4:
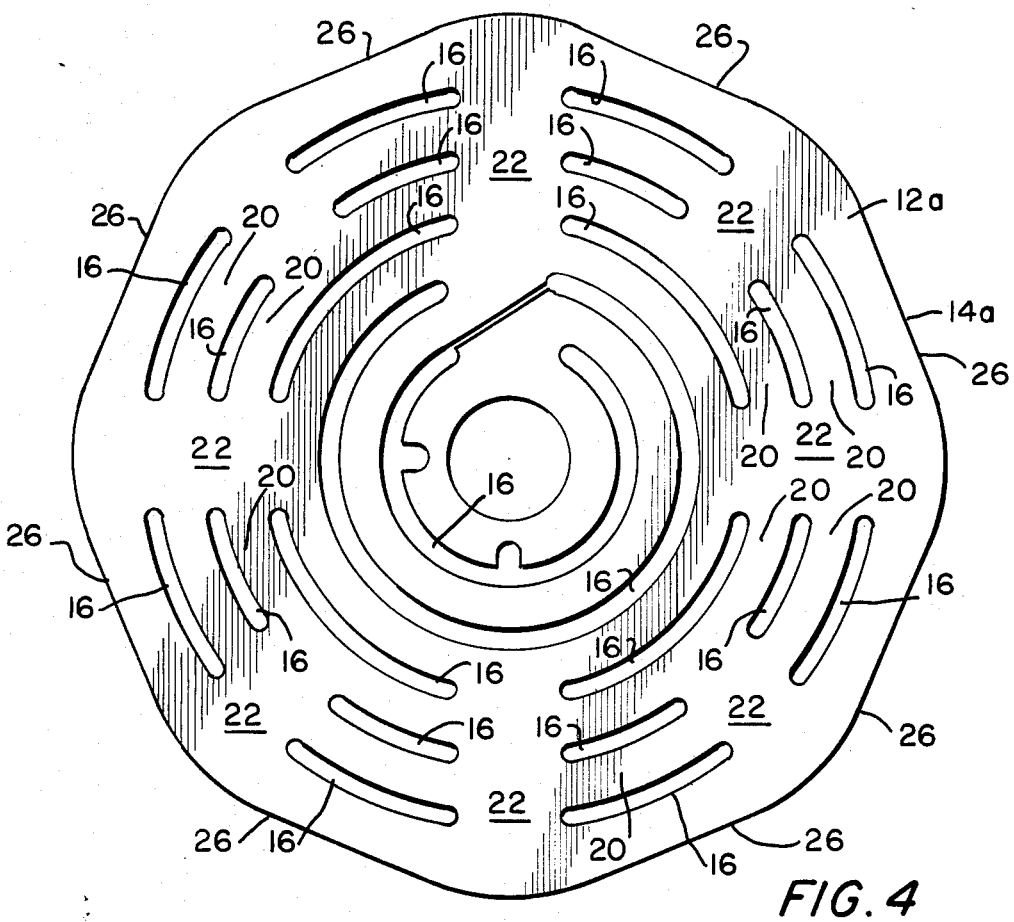
FIG. 4 is a plan view of a first embodiment of the valving element, according to the invention.
Figure 5:
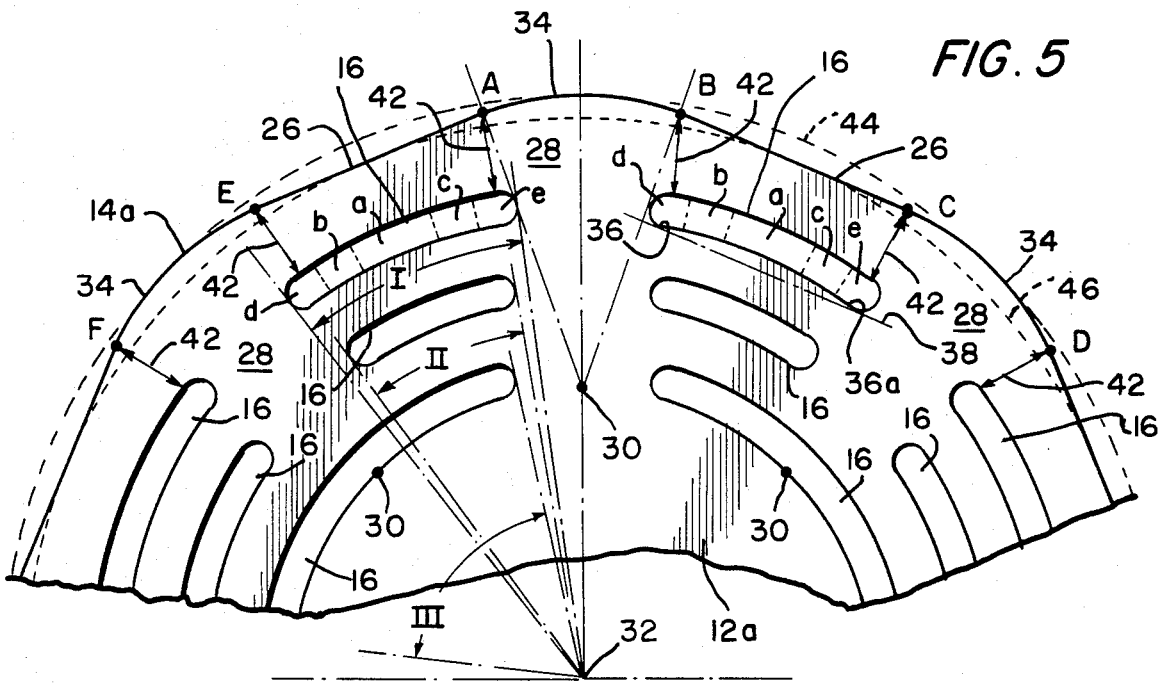
FIG. 5 is a greatly enlarged plan view of a portion of the valving element of FIG. 4.

FIG. 5 shows the novel plate **12*a*, of FIG. 4, in greater, enlarged detail via a portion thereof. Here it can be seen that the outermost flow ports 16 are substantially in parallel with most adjacent, flat edge sections 26 of the periphery 14*a* of the plate 12*a*. The outermost ports 16 are spaced between by arcuate sectors 28 which are substantially devoid of flow ports; sectors 28, for example, encompass areas subsisting between points "A" and "B", "C" and "DA", and "E" and "F", and radius origins 30**.

The flow ports 6 subtend the angles "I", "II", "III" and, in fact, are concentric with the radial center 32 of the plate **12*a*. The sectors 28, however are drawn on foreshortened radii from the origins 30. Hence, they define plate portions, between the outermost ports 16, which are like extending lobes 34. By way of understanding a feature of the invention, each outermost port 16 may be considered to be subdivided into sections "a" through "e". The center section "a", as can be seen, is more proximate to the edge or periphery 14*a* of the plate 12*a* than are the terminal sections "d" and "e". Increased spacing from the periphery 14*a*, for sections "d" and "e" is provided, therefore, by the arcuate sectors 28 or lobes 34 thereof which, due to their foreshortened radii, define some of the undulation of the periphery 14*a***.

Each of the outermost ports 16 has a pair of surfaces 36 and 36*a* which are tangent to an imaginary, broken, straight line 38 drawn therebetween. Lines 38 are parallel with the thereadjacent flat edge sections 26 of the periphery 14*a*, in that such sections 26 are linear. Sections 26 obtain between peripheral points "B" and "C", and "E" and "A"; further ones thereof extend from points "D" and "F".

The ends of the outermost ports 16, then, which were at risk in prior art, plate-type valving elements, are considerably more inboard of the periphery 14*a* in this embodiment of the invention. Such ends enjoy a greater, protective width 42 of plate material to isolate them from impacting shocks, and the latter shocks are more readily dissipated through the thereadjacent sectors 28. As for the greater, intermediate portions of the outermost ports 16, they too are less subject to damaging shock. The thereadjacent linear sections 26 can only effect a line contact, upon impactingly closing on a complementary valve seat (or stop plate). This defines a marked improvement over prior art valving elements which, for being wholly arcuate about the periphery thereof, unavoidably must sustain localized, point-contact impacts.

The plate 12*a* has a maximum outside diameter 44, defined by the sectors 28 or lobes 34, and represented by a broken line, as well as a minimum outside diameter 46, defined by the sectors 26, and represented by a further broken line. The configuration of the plate 12*a*, then, comprises portions defined in part by sectors 28 or lobes 34 which are addendums to the minimum outside diameter 46, and portions defined in part by the sections 26 which are dedendums from the maximum outside diameter 44. For purposes of comparison, diameter 46 may be considered to be the diameter, and to define the conformation of the periphery, of prior art, plate-type, valving elements.

Figure 6:
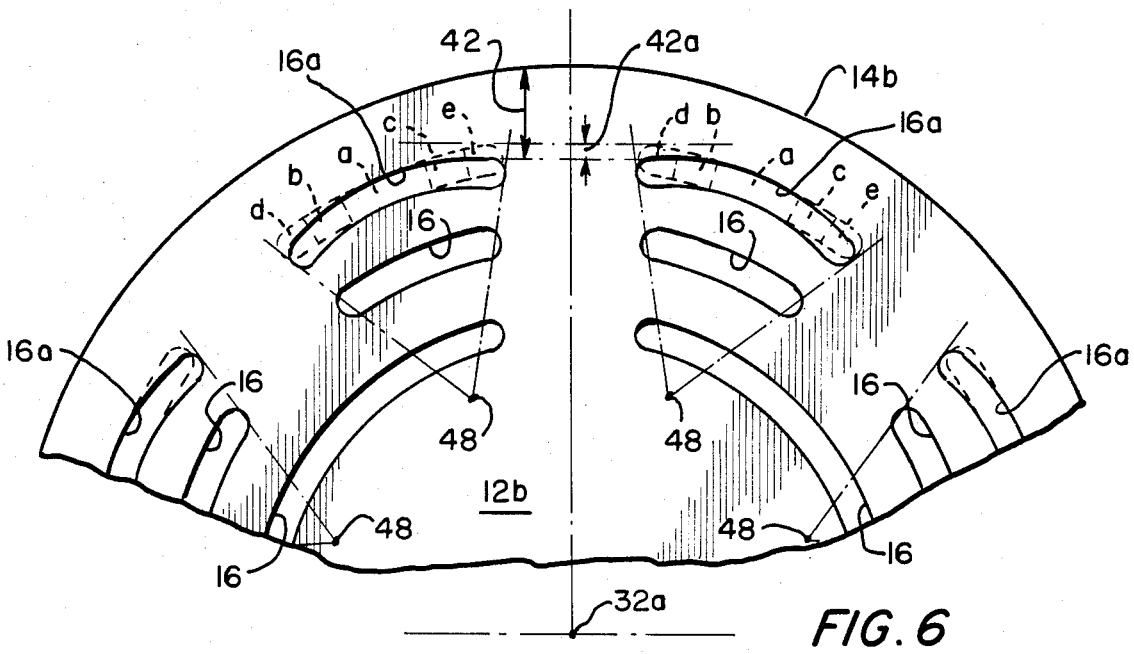
FIGS. 6 and 7 are a plan views, similar to that of FIG. 5, depicting alternate embodiments of the invention.

The alternative embodiment of the invention, shown in FIG. 6, is only a partial view, like that of FIG. 5. Here too, the outermost flow ports 16*a* of the plate 12*b* are formed through arcs drawn from radial centers 48 which are radially outward from the radial center 32*a* of the plate 12*b*. By this teaching, the valve plate 12*b* may retain the circular configuration of the periphery 14*b*, and the ends of the outermost ports 16*a* are yet protected from early fatigue and failure. The ports 16*a* have an arc of narrower angle and thus provide the increased radial dimension 42*a* between the outer ends thereof and a proximity thereof to the outer periphery 14*b* which would obtain if ports 16*a* were concentric with center 32*a*. To revert to FIG. 1, such more-narrowly radiused ports 16*a*, and their radial centers 48, are shown, thereon, in two locations, by ports 16*a* depicted by broken or phantom lines. Thus it can be appreciated how simply the prior art valving elements can easily be improved by a practice of the invention.

As explained, and as shown in FIG. 5, plate 12*a* is so configured as to define an improved, increased spacing, of both of the ends, i.e. sections "d" and "e", of outermost ports 16 from the edge or periphery 14*a*. The lobes 34, however, defining the addendums to the diameter 46, extend further than the width 42 thereof obtaining at the port ends. The further alternative embodiment shown in FIG. 7, comprises a plate 12*c* in which the maximum width afforded by the lobes 34 is used to protect first ends of the outermost ports 16.

Figure 7:
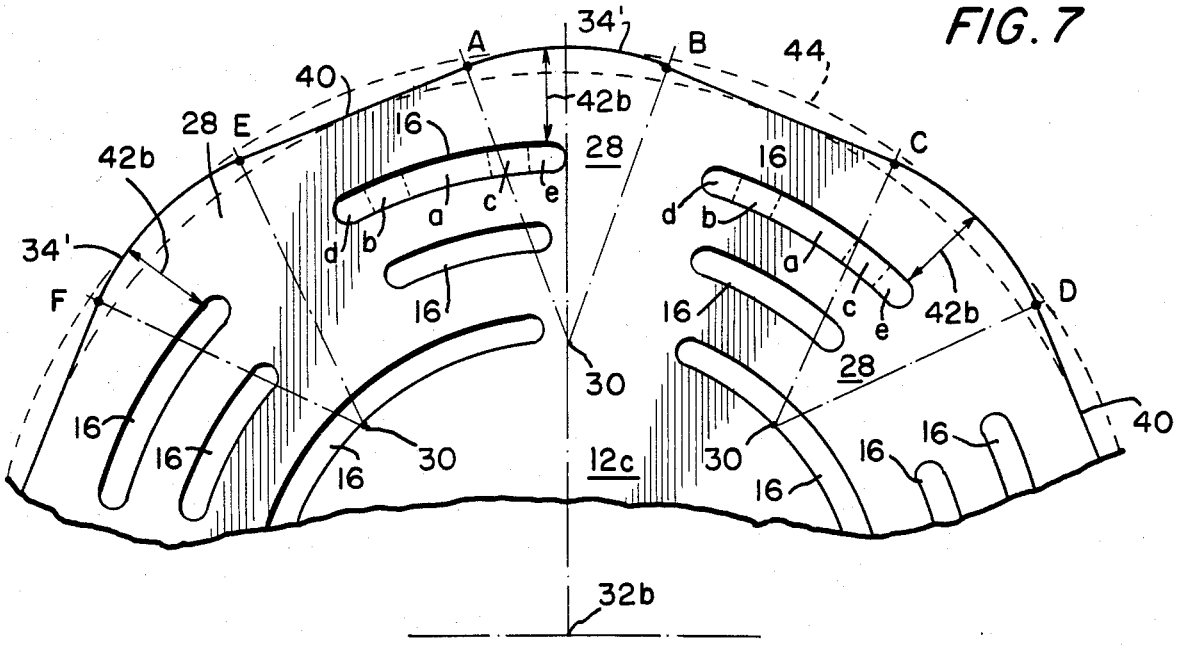

The FIG. 7 embodiment has the lobes 34 and linear sections 40 slightly rotated, relative to the outermost ports 16. Accordingly, first ends, i.e., sections "e", of the latter ports are substantially in the midplane of the sectors 28. Sections "e", of the outermost ports, then, are at a maximum width 42*b* from the periphery 14*c* of the plate 12*c*. Second ends, i.e., sections "d" of the outermost ports 16, are spaced apart from the periphery 14*c* no further, perhaps, than in prior art plates. However, the latter ends or sections "d" subsist in approximately the midplane of the peripheral linear sections 40. Consequently, impacts are borne there along a line contact, and the impacting shock is more widely dispersed.

Figure 8:
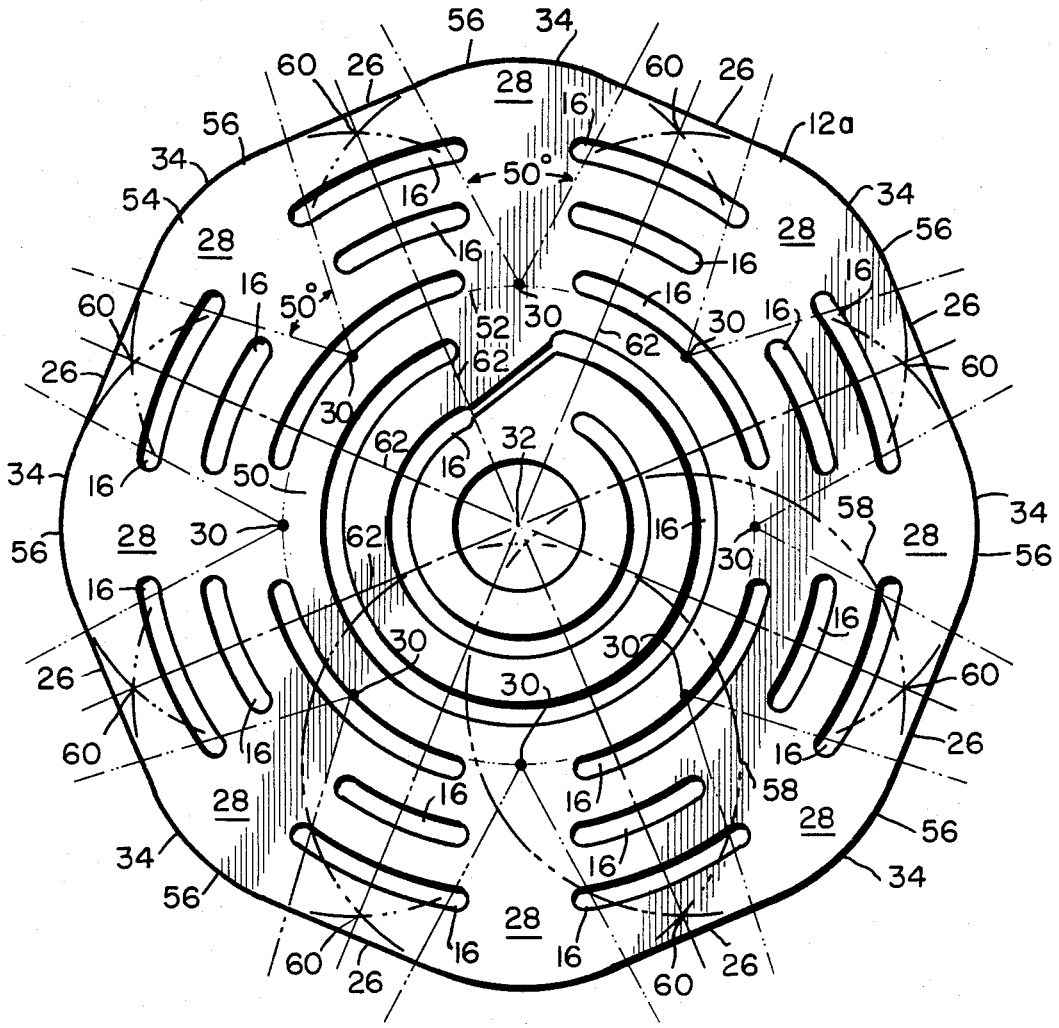
FIG. 8 is a plan view of the first embodiment of the invention, again with geometric reference lines superimposed thereon.

The geometric definitions of the invention are critical to its superior durability. Accordingly, to enhance the disclosure and its clarity, FIG. 8 is provided. The latter corresponds to the first embodiment, as depicted in FIGS. 4 and 5. As shown in FIG. 8, plate 12*a* has a first, central, circular area 50 having an outer circumference 52; the latter is represented by a phantom circle, and is drawn from the plate center 32 on a given radius. Plate 12*a*, then, has a second, outer, annular area 54 which is integral with, and in circumscription of, first area 50. The radius origins 30 of the sectors 28 are traversed by the circumference 52, and the sectors 28, as depicted, are spaced apart from each other.

Each of the sectors 28 is bounded by an arc 56 which is a portion of an imaginary circle 58 (two of which circles are represented in phantom). Area 56, of adjacent sectors 28, or lobes 34, bisect at points 60 in area 54. Then, radial lines 62, drawn radially outward from the center 32, and through points 60, traverse the outermost apertures or flow ports 16. Lines 62 subdivide these flow ports, traversing the midpoint of the length thereof.

The arcs 56 extend through approximately fifty degrees, and on opposite sides of each they merge into tangency with the intervening linear sections 26 of the periphery 14*a*.

While I have described my invention in connection with specific embodiments thereof, it is to be clearly understood that this is done only by way of example, and not as a limitation to the scope of my invention, as set forth in the objects thereof, and in the appended claims.

I claim:

1. A valving element for a plate type valve, comprising:

a plate;

said plate having (a) apertures formed therein for the conduct of fluid therethrough, (b) a given center, and (c) an outer periphery defining the outermost edge of said plate; wherein said apertures subtend given arcs drawn from said given center; and given ones of said apertures each having a first portion intermediate the length thereof which is more proximate to said edge than are other portions thereof which subsist at either sides of said first portion.

2. A valving element, according to claim 1, wherein:

said given ones of said apertures each have surfaces, adjacent opposite ends thereof, which are tangent to a straight line drawn between said surfaces; and respective sections of said edge, which are most adjacent to said given ones of said apertures, are straight and are parallel with said drawn lines.

3. A valving element, according to claim 1, wherein:

sections of said edge are arcuately formed from radial centers spaced apart from said given center.

4. A valving element, according to claim 1, wherein:
sections of said edge are linear; and
said first portions of said given ones of said apertures are more proximate, as aforesaid, to said linear sections of said edge.

5. A valving element, according to claim 4, wherein:
each of said linear sections of said edge join others thereon through intervening sectors of said plate;
each of said intervening sectors terminates in a portion of said edge which has an arcuate conformation drawn from a radial center located outward from said given center.

6. A valving element, according to claim 5, wherein:
said sectors encompass areas of said plate which are substantially devoid of apertures.

7. A valving element for a plate type valve, comprising:
a plate;
said plate having (a) apertures formed therein for conduct of fluid therethrough, (b) a given center, and (c) an outermost periphery; and
said periphery is defined, at least in part, by a plurality of radii drawn from radial centers which are located inwardly of said periphery and are spaced apart from said given center.

8. A valving element, according to claim 7, wherein:
said plate has a maximum outside diameter; and
given portions of said periphery comprise dedendums relative to said diameter.

9. A valving element, according to claim 7, wherein:
said plate has a minimum outside diameter; and
prescribed portions of said periphery comprise addendums relative to said diameter.

10. A valving element, according to claim 7, wherein:
said apertures are of arcuate configuration and are concentric with said given center.

11. A valving element for a plate type valve, comprising:
a plate;
said plate having (a) apertures formed therein for conduct of fluid therethrough, (b) a given center, and (c) an outermost periphery; and
said periphery is defined, at least in part, by a plurality of radii drawn from radial centers which are spaced apart from said given center; wherein
said plate has a maximum outside diameter;
given portions of said periphery comprise dedendums relative to said diameter; and
said given portions each define substantially linear edges of said plate.

12. A valving element for a plate-type valve, comprising:
a substantially circular plate;
said plate having apertures formed therein for the conduct of fluid therethrough, (b) a given center, and (c) an outer periphery defining the outermost edge of said plate; wherein
said apertures comprise flow ports which subtend arcs drawn from said given center;
said ports each having a first section intermediate the length thereof, and second and third sections at opposite ends thereof;
said outermost edge of said plate has given portions thereof which are more proximate to at least one of said first, second and third sections of said ports than to others of said sections; and
each of said more proximate, given portions of said edge defines means, responsive to a closure thereof onto a flat surface, for causing said portion to impact, with such a flat surface, only with a full line contact.

13. A valving element, according to claim 12, wherein:
said given portions of said edge are more proximate to said first sections of said ports.

14. A valving element, according to claim 12, wherein:
said given portions of said edge are more proximate to one of said second and third sections of said ports.

15. A valving element for a plate type valve, comprising:
a plate;
said plate having (a) apertures formed therein for conduct of fluid therethrough, (b) a given center, and (c) an outermost periphery; and
said periphery is defined, at least in part, by a plurality of radii drawn from radial centers which are spaced apart from said given center; wherein
said plate further has a first, central, circular area, having a given circumference;
said circumference has a radius drawn from said given center;
said plate further has a second, outer, annular area integral with, and in circumscription of, said first area;
said periphery comprises an outermost edge of said plate;
said radial centers are traversed by said circumference; and
said radii of said plurality thereof define said second area with a plurality of spaced-apart sectors.

16. A valving element, according to claim 15, wherein:
said sectors extend through approximately fifty degrees of arc.

17. A valving element, according to claim 15, wherein:
each of said sectors is defined by an arc which intersects another such arc, of another, adjacent one of said sectors, at a prescribed point on said second area; and
an imaginary, radial line, drawn radially outward from said given center and through said prescribed point, traverses an outermost one of said apertures substantially across a midpoint of the length of said one aperture.

18. A valving element, according to claim 15, wherein:
said radii of said plurality thereof define said edge with a plurality of spaced-apart, arcuate lobes;
said edge has a plurality of linear portions; and
adjacent ones of said lobes are joined therebetween by an intervening one of said linear portions.

19. A valving element, according to claim 18, wherein:
each of said intervening, linear portions of said edge is tangent to those of said adjacent lobes which said linear portion joins.

20. A valving element, according to claim 18, wherein:
said lobes number in excess of four.

21. A valving element, according to claim 18, wherein: said lobes, in sum total, are of an even number.

* * * * *